United States Patent [19]

Ricken

[11] Patent Number: 4,974,397

[45] Date of Patent: Dec. 4, 1990

[54] ANTI-STRESS SADDLE PAD FOR HORSES

[76] Inventor: Jim Ricken, Q3 Latigo Dr., Canutillo, Tex. 79835

[21] Appl. No.: 421,645

[22] Filed: Oct. 16, 1989

[51] Int. Cl.[5] ..... B68C 1/12

[52] U.S. Cl. ..... 54/66

[58] Field of Search ..... 54/44, 65, 66

[56] References Cited

U.S. PATENT DOCUMENTS

| | | | |
|---|---|---|---|
| 2,072,188 | 3/1937 | Tauber | 54/66 |
| 3,323,287 | 6/1967 | Hilmer | 54/66 |
| 4,683,709 | 8/1987 | Vasko et al. | 54/66 |
| 4,695,496 | 9/1987 | Lee | 54/66 X |

FOREIGN PATENT DOCUMENTS

| | | | |
|---|---|---|---|
| 390677 | 4/1933 | United Kingdom | 54/66 |

*Primary Examiner*—Robert P. Swiatek

*Attorney, Agent, or Firm*—Charles C. Logan, II

[57] ABSTRACT

The anti-stress saddle pads have been designed to relieve the pressure, shock forces and stress on a horse's spine, back muscles and top of its shoulders. The basic structure of the saddle pad is formed of multiple layers of material that from top to bottom are as follows: a sheet of felt, a sheet of visco-elastic polymer, and a sheet of open-celled polyurethane foam. The sheet of visco-elastic polymer functions to absorb shock forces transmitted to its top surface by a horseback rider and to dissipate this force laterally throughout the layer of material. The sheet of open-celled polyurethane foam absorbs impact shocks and vibrations and it has the ability to allow its bottom surface to conform to the contour of a horse's back.

6 Claims, 2 Drawing Sheets

ANTI-STRESS SADDLE PAD FOR HORSES

BACKGROUND OF THE INVENTION

The invention relates to horses and more specifically to saddle pads used on horses.

One of the problems that horses that are ridden for pleasure or for racing have relates to the stresses applied to the horse's spine, back muscles and the top of its shoulders. Most horses are ridden with a saddle on them and the bottom surface of the saddle has a tendency to dig into the horse's back. Rough spots and other protrusions on the bottom of the saddle dig into the horse's skin and its underlying skeletal structure. The weight of the rider constantly bouncing down on the horse's back adds further stress to its anatomy.

It is an object of the invention to provide a novel anti-stress saddle pad for a horse that will help to eliminate spine and shoulder pressure and to place most of the rider and saddle pressure on its ribs where it should be.

It is also an object of the invention to provide a novel anti-stress saddle pad for a horse that will distribute the up and down shock waves of the rider sideways throughout the material of the saddle pad.

It is another of the invention to provide a novel anti-stress saddle pad for a horse that has a structural layer of material that allows the pressure to flow like a fluid and distributes the weight of the rider and saddle evenly thereby reducing pressure points.

It is a further object of the invention to provide a novel anti-stress saddle pad for a horse that has a bottom layer of sheet material that has the ability to flow and conform to the contour of a horse's back.

It is an additional object of the invention to provide a novel anti-stress saddle pad for horses that is economical to manufacture and market.

SUMMARY OF THE INVENTION

Applicant's novel anti-stress saddle pad has been designed to eliminate spine and shoulder pressure resulting from a saddle and a rider mounted thereon. Most of this rider and saddle pressure is distributed to the ribs where it should be.

The anti-stress saddle pad has an elongated body having a predetermined length and thickness. The basic structure of the elongated body is formed of multiple layers of material that from top to bottom are as follows: (a) a sheet of felt, (b) a sheet of visco-elastic polymer, and (c) a sheet of open-celled polyurethane foam. The sheet of visco-elastic polymer functions to absorb shock forces transmitted to its top surface by a horseback rider and to dissipate this force laterally throughout the layer of material. Thus the forces on the horse's back created by the up and down motion of the rider has its shock waves distributed sideways throughout the sheet of material. The sheet of open-celled polyurethane foam also absorbs impact shocks and vibrations and it has the ability to conform to the contour of a horse's back. It absorbs up to ninety-seven percent of the impact shocks and vibrations without bounce thus reducing fatigue. The layer of open-celled polyurethane foam softens from body contact temperature but maintains firm support away from the body surface. Its softness allows it to conform to the contour of the horse's back but it does not bottom out. It has high resiliency so that it slowly returns to its original form after compression, thus reducing back pressure. It softens with increased humidity and transfers moisture away from the body to aid in cooling it.

The saddle pad has an elongated body having a ridge portion with lateral edges. Stitching that extends from the top layer down through the bottom layer forms fold lines that functions as hinges about which the outer portion of the saddle pad folds. There is no layer of visco-elastic polymer in the ridge portion. Instead there is an elongated open spaced chamber formed therein between the sheet of felt and the sheet open-celled polyurethane foam. The front end of the saddle pad has flap members formed on each of its respective side edges. There is no layer of visco-elastic polymer in these flap members. The inner edge of the flap members are stitched from the top layer down through the bottom layer to form fold lines about which the flap members hinge.

The top surface of the layer of felt material is covered by a sheet of vinyl and around its outer periphery is a layer of leather having a predetermined configuration. The leather strips are stitched in a quilted manner to form a raised convex-shaped roll on the top surface of the pad and they function to lock-in a saddle tree placed thereon. The saddle tree runs from front to back and is generally made of wood or fiberglass.

DESCRIPTION OF THE PREFERRED EMBODIMENT

Applicant's novel anti-stress saddle pad for a horse will be described by referring to FIGS. 1–8 of the drawings. The anti-stress saddle pad is generally designated numeral 10.

Figure 1:
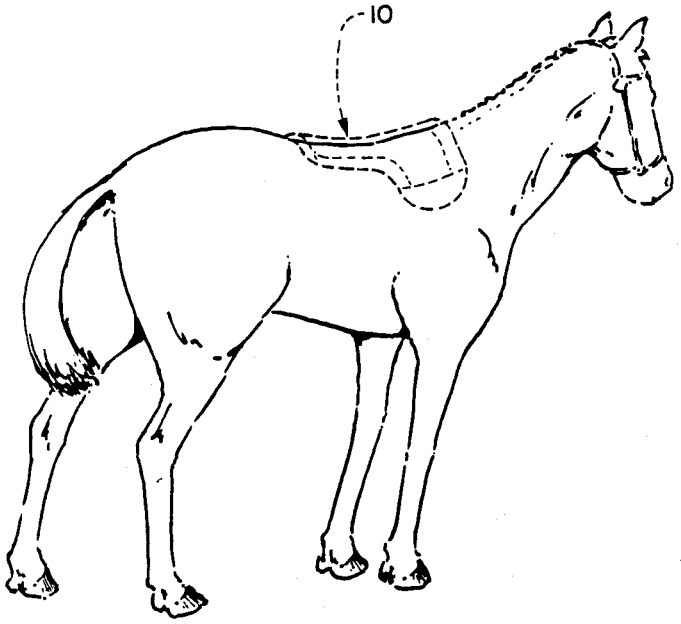
FIG. 1 is a rear perspective view of a horse illustrating with dotted lines where the novel anti-stress saddle pad would rest on the horse's back.
Figure 2:
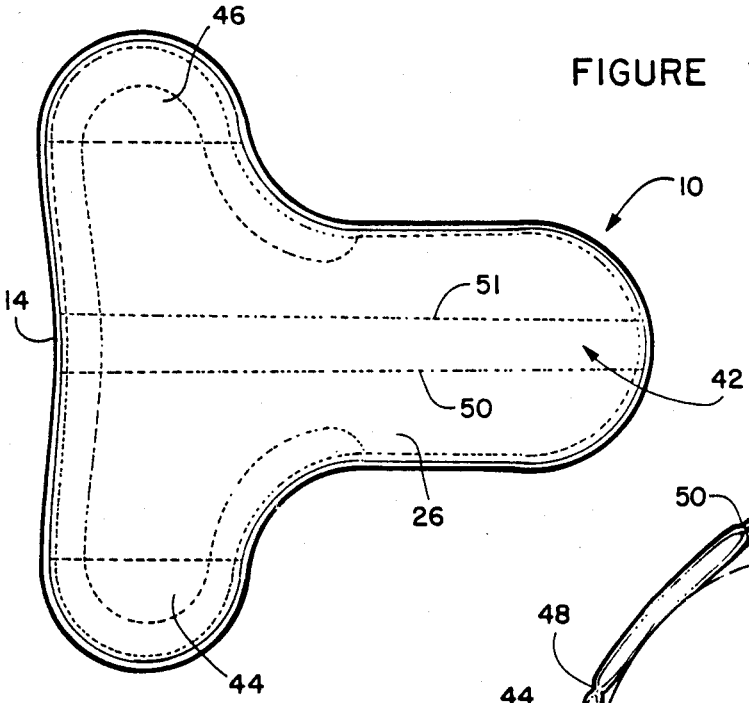
FIG. 2 is a bottom plan view of the anti-stress saddle pad.
Figure 3:
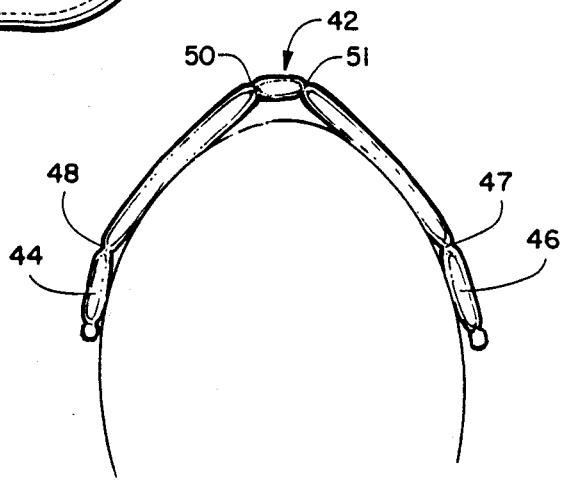
FIG. 3 is a schematic end elevation view showing how the anti-stress saddle pad rests on the horse's back.

In FIG. 1, a horse is illustrated along with dotted lines on its back that indicate the position upon which the anti-stress saddle pad would rest.

Figure 4:
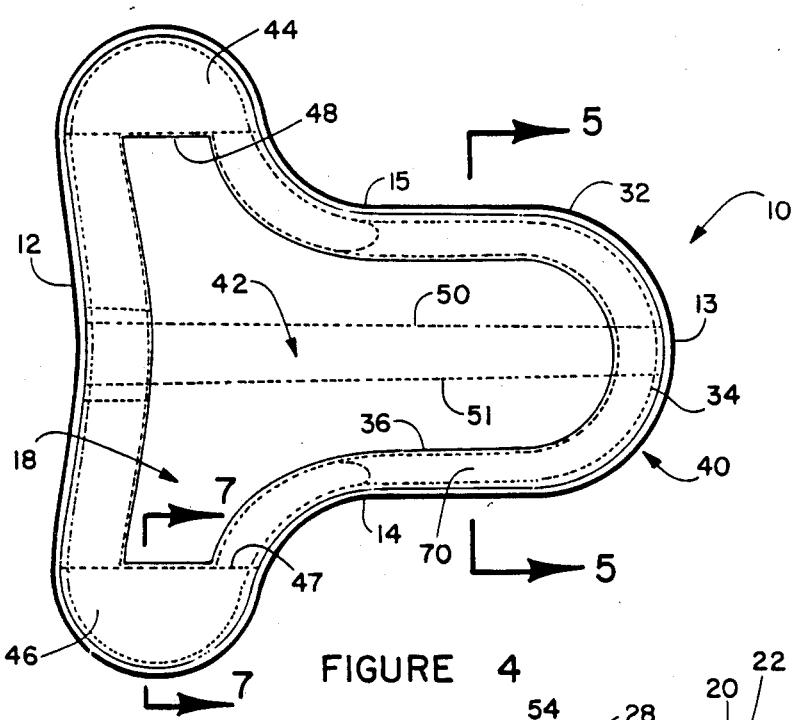
FIG. 4 is a top plan view of the anti-stress saddle pad.
Figure 5:
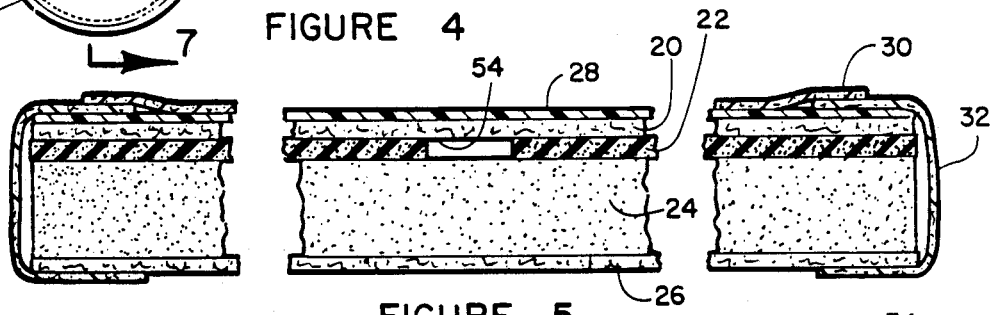
FIG. 5 is a cross sectional view taken along lines 5—5 of FIG. 4 showing the layers of material prior to being stitched together.
Figure 6:
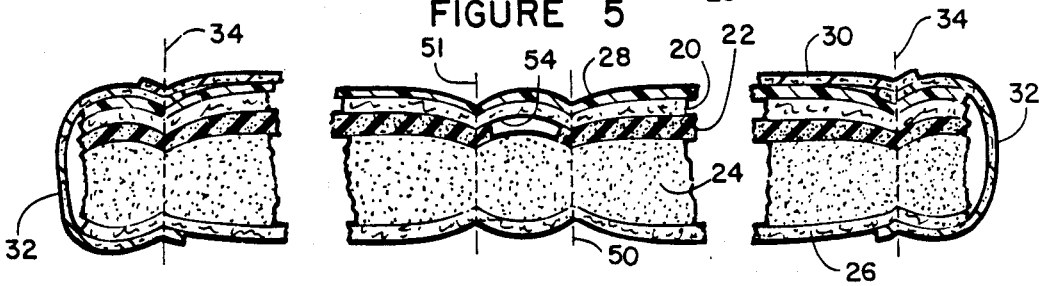
FIG. 6 is a cross sectional elevation view showing what the different layers illustrated in FIG. 5 look like after they have been stitched from the top layer down through the bottom layer.
Figure 7:
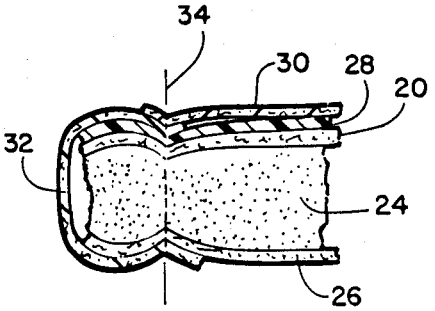
FIG. 7 is a cross sectional view taken along lines 7—7 of FIG. 4.

Looking to FIG. 4, saddle pad 10 is seen to have a front end 12, a rear end 13, a left side edge 14, and a right side edge 15. Its basic structure is an elongated body 18 that is formed of multiple layers of material that from top to bottom are as follows: (a) a sheet of felt 20, (b) a sheet of visco-elastic polymer 22, (c) a sheet of open-celled polyurethane foam 24, and (d) a sheet of felt 26. A sheet of vinyl 28 covers the top surface of the saddle pad and a trim strip of leather 30 is positioned around its outer periphery. Trim strip 32 passes around the outer edge of the saddle pad and is held in place by stitching 34.

Figure 8:
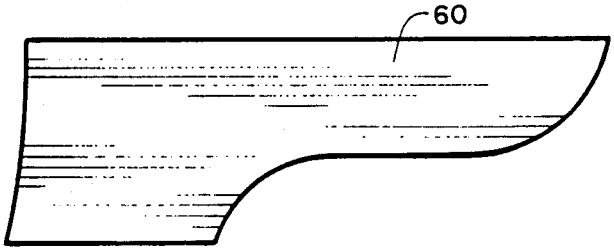
FIG. 8 is a top plan view of the left side panel of visco-elastic polymer material.

Saddle pad 10 has a tongue portion 40, a ridge portion 42, a right flap member 44 and a left flap member 46. Stitching 47 forms a fold line and stitching 48 forms a fold line for the respective flap members 46 and 44. Stitching 50 and 51 form fold lines denoting the lateral edges of ridge portion 42. An elongated open spaced chamber 54 is formed in ridge portion 42 where the layer of visco-elastic polymer material has been left out. The shape of the left side of visco-elastic polymer material is illustrated in FIG. 8 and it is identical to the right side. It does not extend into ridge portion 42 nor flap member 46 (see cross sectional view 7). Stitching 36 forms a raised convex-shaped quilted roll 70 on the top surface of the pad that functions to lock-in a saddle tree placed thereon so that it can't slip off.

What is claimed is:

1. An anti-stress saddle pad for a horse comprising:

an elongated body having a predetermined length and a predetermined thickness, said elongated body having a front end, a rear end and laterally spaced side edges, said elongated body being formed of multiple layers of material that from top to bottom are as follows: (a) a sheet of felt, (b) a sheet of visco-elastic polymer that functions to absorb shock forces transmitted to its top surface by a horseback rider and to dissipate this force laterally throughout the layer of material, and (c) a sheet of open-celled polyurethane foam that absorbs impact shocks and vibrations and having a top surface and a bottom surface, said sheet of open-celled polyurethane foam having properties that allow it to soften from body contact temperature from a horse's back but also maintaining firm support away from a horse's body surface, its softness properties allow its bottom surface to conform to the contour of a horse's back but it does not bottom out:

said elongated body having a ridge portion having a predetermined width that extends along its length, the ridge portion has lateral edges and fold lines are formed along both these lateral edges and they function as hinges about which the outer portions of said saddle pad fold downwardly on opposite lateral sides of a horse's backbone, and there being an absence of the visco-elastic polymer layer in said ridge portion thereby forming a longitudinally extending open space chamber.

2. An anti-stress saddle pad for a horse as recited in claim 1 wherein a raised convex-shaped quilted roll is formed on the top surface of said pad around its periphery that functions to lock-in a saddle tree placed thereon so that it can't slip.

3. An anti-stress saddle pad for a horse as recited in claim 1 wherein there is a sheet of vinyl on top of said sheet of felt.

4. An anti-stress saddle pad for a horse as recited in claim 1 wherein said elongated body has a tongue portion formed at its rear end and its width is less than the width of said elongated body at its front end.

5. An anti-stress saddle pad for a horse as recited in claim 1 wherein said elongated body portion has flap members formed along its side edges adjacent its front end, said flap members having a fold line adjacent their inner edge that function as hinges about which the flap members fold.

6. An anti-stress saddle pad for a horse as recited in claim 5 wherein there is not a layer of visco-elastic polymer in said flap members.

* * * * *